US006730647B2

(12) United States Patent
Wäschenbach et al.

(10) Patent No.: US 6,730,647 B2
(45) Date of Patent: May 4, 2004

(54) COMPOSITION FOR A DISHWASHER IN THE FORM OF A TABLET

(75) Inventors: Guido Wäschenbach, Oakland (DE); Harald Magg, Ladenburg (DE); Richard Neergaard, Brussels (BE); Enric Carbonell, Barcelona (ES); Ralf Wiedemann, Griesheim (DE)

(73) Assignee: Rackitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/184,519

(22) Filed: Jun. 28, 2002

(65) Prior Publication Data

US 2003/0050206 A1 Mar. 13, 2003

Related U.S. Application Data

(63) Continuation of application No. PCT/EP00/13277, filed on Dec. 27, 2000.

(30) Foreign Application Priority Data

Dec. 29, 1999 (DE) ..... 199 63 570

(51) Int. Cl.[7] ..... C11D 17/00

(52) U.S. Cl. ..... 510/224; 510/226; 510/227; 510/441; 510/446

(58) Field of Search ..... 510/224, 226, 510/227, 441, 446

(56) References Cited

U.S. PATENT DOCUMENTS

| | | | | |
|---|---|---|---|---|
| 5,972,870 | A | * 10/1999 | Anderson | 510/298 |
| 6,264,985 | B1 | * 7/2001 | Cremer | 424/473 |
| 6,514,429 | B1 | * 2/2003 | Waschenbach et al. | 252/181 |

FOREIGN PATENT DOCUMENTS

| | | | |
|---|---|---|---|
| DE | 197 58 181 | A1 | 7/1999 |
| DE | 298 23 505 | U1 | 7/1999 |
| EP | 0 055 100 | A1 | 6/1982 |
| EP | 0 481 547 | A1 | 4/1992 |
| JP | 09175992 | A2 * | 7/1997 |
| WO | WO 98/55590 | A1 | 10/1998 |
| WO | WO 99/24548 | A1 | 5/1999 |
| WO | WO 99/27064 | A1 * | 6/1999 |
| WO | WO 99/27067 | A1 * | 6/1999 |
| WO | WO 99/27069 | A1 | 6/1999 |
| WO | WO 00/06688 | A1 | 2/2000 |
| WO | WO 00/52127 | A1 | 9/2000 |

OTHER PUBLICATIONS

U.S. patent application Ser. No. 09/509,642, Wäschenbach et al.
U.S. patent application Ser. No. 09/744,727, Wäschenbach et al.
U.S. patent application Ser. No. 09/744,726, Wäschenbach et al.
U.S. patent application Ser. No. 09/744,723, Wäschenbach et al.
U.S. patent application Ser. No. 09/744,724, Wäschenbach et al.

* cited by examiner

*Primary Examiner*—Lorna M. Douyon
(74) *Attorney, Agent, or Firm*—Akin Gump Strauss Hauer & Feld, L.L.P.

(57) ABSTRACT

A composition is provided for use in a dishwashing machine and in the form of a tablet. The composition is characterized by having at least two small parts, which are placed in or on the tablet, and in which at least one functional substance is concentrated in each case thus enabling the respective small part to be released by dissolution at a determined point in time during the dishwashing cycle. The small parts are produced by using at least two different methods.

6 Claims, 1 Drawing Sheet

COMPOSITION FOR A DISHWASHER IN THE FORM OF A TABLET

CROSS-REFERENCE TO RELATED APPLICATIONS

This application is a continuation of International Application No. PCT/EP00/13277, filed Dec. 27, 2000, the disclosure of which is incorporated herein by reference.

BACKGROUND OF THE INVENTION

The present invention relates to a composition for use in a dishwasher, in the form of a tablet with a base composition.

Although modem dishwashers usually have a plurality of washing programs which differ in terms of the duration and temperature of the individual washing cycles, all essentially consist of the following basic steps:

pre-rinse cycle, main washing cycle; one or more intermediate rinse cycles; a final rinse cycle; and drying. During the course of a dishwasher program, a series of products is metered into the dishwasher to assist the respective stage of the cycle. For example, the actual dishwasher detergent intended to provide the cleaning action is added at the start of the main washing cycle.

Special substances are used during the final rinse cycle, e.g. rinse agents. The purpose of rinse agents is to prevent drops of water from being left on the rinsed items as they are rinsed with water, which would otherwise leave behind specks of the substances dissolved/dispersed in the drops, in particular salts, after drying.

In addition to rinse agents, other substances may be used, which become active during the final rinse cycle, e.g. produce an anti-bacterial action (e.g. cationic compounds or triclosan), protect silver (e.g. benzotriazol), impart fragrance (fragrances, perfume), add bleaching/disinfecting action (e.g. chlorine bleaches), neutralize odors (e.g. polyvinyl pyrrolidone), means of removing deposits and enzymes (e.g. lipase for removing fatty deposits from the washed articles).

Dishwasher detergents in tablet format are known from the prior art and may be produced in a number of different embodiments.

In recent times, dish washer detergents in the form of multi-phase tablets have attracted particular interest and are increasingly gaining acceptance on the market.

For example, a molding of a dishwasher detergent with a specific volume ratio is known from German patent specification DE 197 58 171 (Henkel), wherein the total quantity of a specific ingredient is contained in a defined region of the molding. The defined region in this case is at most 40% by volume of the total volume of the molding. A preferred embodiment of this molding is a tablet with a depression and this depression contains the ingredient. The manufacturing process specifically involves forming a recess into a molding and this recess is filled with a liquid mixture of paraffin and an active ingredient, for example.

A molding of a washing and cleansing agent made from a compressed particulate material is known from German patent specification DE 298 23 505 (Henkel), which has a core and a shell encasing this core, the specific contour of the core imparting a particular stability to the molding.

A detergent molding comprising a compressed phase and a non-compressed phase is known from International patent specification WO 99/24548 (Procter & Gamble), for example. The detergent tablet in this case comprises a compressed base body with at least one depression and a non-compressed, gelatinous part, which is arranged in the at least one depression, whereby the gelatinous part may contain a whole range of ingredients) and the two phases dissolve at different times of the dishwasher cycle. This being the case, gelatinous, non-compressed phase dissolves more slowly than the compressed base body.

From International patent specification WO 99/27069 (Procter & Gamble)—dating from about the same time—a detergent tablet is known, in which the compressed base body dissolves more quickly than the gelatinous, non-compressed second phase.

BRIEF SUMMARY OF THE INVENTION

Accordingly, the underlying objective of the present invention was to develop a composition for use in a dishwasher in the form of a tablet with a base composition, which would be more flexible in terms of manufacturing the composition and would exhibit improved control of the sequence in which the ingredients of the composition are released during the course of the dishwasher cycle.

This objective is achieved by the invention in the form of a composition for use in a dishwasher in the form of a tablet, with a base composition, characterized by at least two pellets arranged in or on the tablet, in which at least one functional substance is concentrated respectively, which is released at a fixed point in time during the dishwasher cycle when the respective pellet is dissolved, the pellets being made by at least two different methods.

By preference, at least one pellet is compressed and at least one other pellet is non-compressed.

It is further proposed by the invention that at least one pellet be provided with a substantially complete coating, which can be dissolved on exposure to external parameters in the dishwasher, such as temperature and/or pH value, for example.

By preference, the coating is provided with an additional water-soluble protective coating.

This being the case, it is proposed, in a preferred embodiment, that a pellet should contain at least one substance which becomes active substantially in the final rinse cycle of the dishwasher and at least one other pellet contains at least one substance which prevents lime scale deposits in the dishwasher or on the washed articles.

Finally, it is proposed by the invention that the individual pellets should contain means exhibiting anti-bacterial activity, means to protect silver, fragrances, bleaching agents/disinfecting agents, odor neutralizers, means for removing deposits and/or enzymes, separately or in any combination.

The composition proposed by the invention is distinctive because it produces outstanding results when used in a dishwasher and in particular enables exact control of the release of the individual ingredients. Furthermore, it offers greater flexibility in terms of production. The base composition of the tablet dissolves during the main washing cycle to fulfill its intended function. The pellets arranged on the tablet contain the substances with the other desired functionalities, and are intended to be released at fixed points in time during the course of the dishwasher cycle.

If the substances in the pellets have a coating, it may be dissolved by the change in pH value or temperature during the dishwasher cycle, so that the encased ingredient is released at a fixed point in time.

Although not wishing to be restricted to it, a preferred embodiment comprises a tablet with two pellets arranged therein or thereon, the one pellet being made by a pressing process and containing one or more enzymes together with an effervescent system comprising sodium bicarbonate and citric acid, for example, i.e. it effervesces on contact with water and dissolves rapidly, while the other pellet is not pressed but is made by an extrusion/sphere-producing or similar process, for example, and contains one or more substances with a rinsing action, together with a wax to delay dissolution or a coating which does not dissolve until the pH value decreases during the final rinse cycle.

Provided no special metering aids are used to hold back the pellets proposed by the invention, the size of the pellets proposed by the invention may be selected so that they are not entrained out of the dishwasher at least to any significant degree before the fixed points in time during the dishwasher cycle at which their ingredients are intended to be released.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
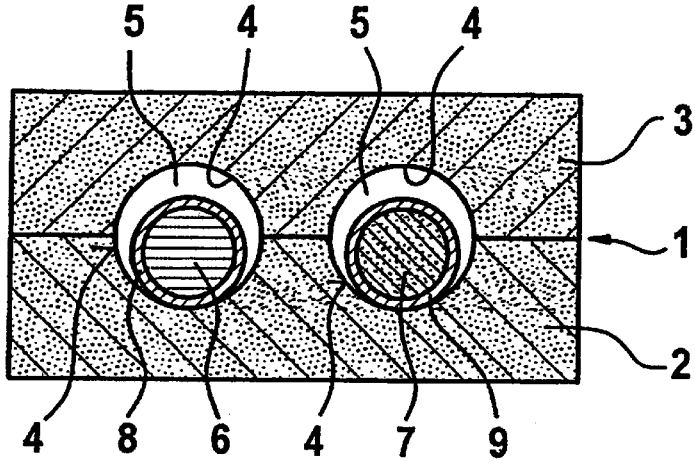
FIG. 1 is a cross section of a first embodiment of the composition proposed by the invention.

FIG. 1 illustrates a tablet 1 in the form of a two-layered tablet with a bottom layer 2 and a top layer 3. One of the standard, commercially available tablets may be used as the base, in which case the two layers will usually be of a different composition and will be of different colors.

Depressions 4 are provided in the top layer 3 and the bottom layer 2 so that when the bottom layer 2 and the top layer 3 are placed one on top of the other two cavities 5 are formed in which respectively a pellet 6 and a pellet 7 are accommodated. These two pellets are made by different methods. For example, the pellet 6 might be provided in the form of a non-compressed, e.g. gelatinous state, whereas the pellet 7 may be in compressed format. The pellets 6 and 7 may be secured in the depression 4 by means of an adhesive, for example. As will be evident to the person skilled in the art, the number of depressions 4, their layout and in particular the shape and number of pellets are not restricted to the embodiment specifically illustrated in FIG. 1.

Figure 2:
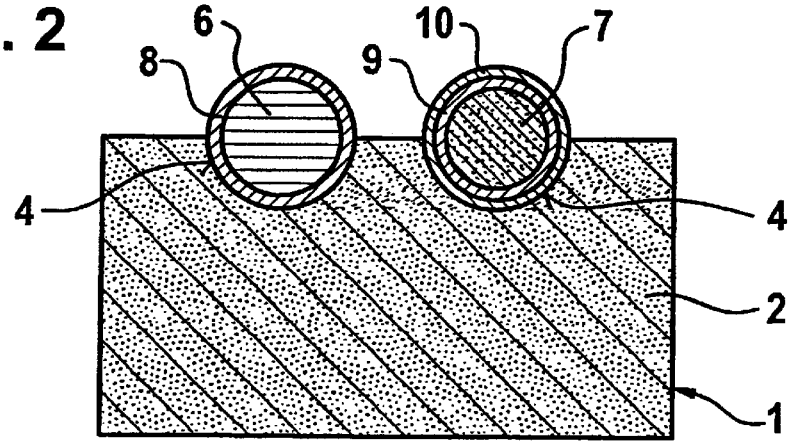
FIG. 2 is a cross section of a second embodiment of the composition proposed by the invention.
Figure 3:
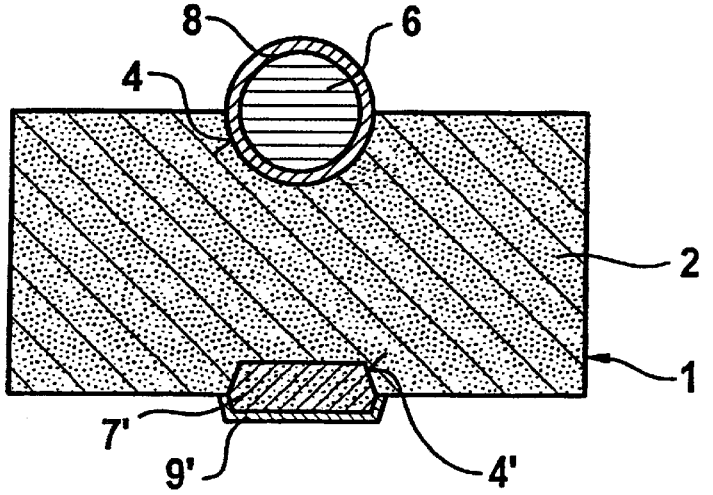
FIG. 3 is a cross section of a third embodiment of the composition proposed by the invention.

In the embodiment illustrated, the pellets 6 and 7 are shown with a coating layer 8, 9, although it should be pointed out that both in this diagram and the diagrams of FIG. 2 and FIG. 3, the drawings are not shown to the correct scale in order to retain clarity.

The coatings 8 and 9 may be of different or the same materials. This being the case, the materials of the coating layer 8 and 9 may be selected, for example, so that they dissolve depending on external parameters in the dishwasher, for example the pH value and the temperature, and thereby enable the ingredients of the pellets 6, 7 to be released at fixed points in time during the dishwasher cycle. The embodiment illustrated in FIG. 1 illustrates the possibility of controlling to a very accurate degree the sequence in which the different ingredients of the composition for use in a dishwasher are released. Furthermore, the fact of separating individual ingredients in different pellets offers greater flexibility in terms of manufacturing these compositions. Separating individual ingredients in different pellets also prevents substances which are essentially incompatible from coming into contact and thus protects the function and reactivity of the individual ingredients. To obtain a high degree of flexibility in the production process and to enable accurate control of the release pattern, it is very important that the pellets should be made by different methods.

FIG. 2 illustrates another embodiment of the composition proposed by the invention, in which the tablet 1 comprises only a single layer 2, in which two depressions 4 are provided, in which pellets 6 and 7 are duly accommodated. Secured in the depressions by means of an adhesive, the two pellets 6 and 7 differ in terms of the process by which they were manufactured but are otherwise the same as the pellets 6 and 7 illustrated in FIG. 1. Pellet 7 has an additional water-soluble protective coating 10, to protect the coating 9 during storage and transportation. The coating 10 essentially dissolves as early as the main wash cycle of the dishwasher at the same time as the tablet 1 dissolves.

FIG. 3 illustrates another embodiment of the composition proposed by the invention. Again, the tablet 1 comprises only a single layer 2. In this embodiment, a compressed pellet 6 with a protective coating 8 is arranged on the one longitudinal face of the tablet 1, while the pellet 7, which is not compressed and has a coating layer 9', is secured in a depression 4' on the other longitudinal face of the tablet 1. The different depressions 4, 4' may be made by press-molding the base composition of the tablet 1 accordingly. This embodiment demonstrates how the pellets may be arranged in or on the tablet in various positions of the tablet 1; similarly the pellet may be of any freely selectable shape.

Although only two pellets separated from one another are shown in the embodiments illustrated in the respective drawings, other specific embodiments are also possible within the scope of the invention, such as more than two pellets or an arrangement with one of the pellets embedded in the other pellet (or joined thereto in any other form).

The features of the invention disclosed in the description, claims and drawings may essentially be used individually and in any combination to implement the invention in its different embodiments.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A composition for use in a dishwasher, comprising a base composition in a form of a tablet with at least two pellets arranged in depressions or on the tablet, each of the at least two pellets comprising at least one functional substance which is released during a cycle of the dishwasher upon dissolution of the pellet, wherein the functional substance in each respective pellet is different, and wherein at least one pellet is in a compressed format and at least a second pellet is in a non-compressed format.

2. The composition as claimed in claim 1, wherein at least one pellet comprises a substantially complete first coating which dissolves on exposure to an external parameter in the dishwasher.

3. The composition as claimed in claim 2, wherein the external parameter is at least one of temperature and pH value.

4. The composition as claimed in claim 2, further comprising an additional substantially water-soluble protective coating around the first coating.

5. The composition as claimed in claim 1, wherein at least a first pellet comprises at least one substance which becomes active substantially during a final rinse cycle of the dishwasher; and at least a second pellet comprises at least one substance which prevents a lime scale deposit in the dishwasher or on a washed article.

6. The composition as claimed in claim 1, wherein the at least one functional substance comprises at least one selected from the group consisting of a substance having an anti-bacterial action, a substance to protect silver, a fragrance, a bleaching agent, a disinfecting agent, an odor neutralizer, and a means to remove a deposit or an enzyme.

* * * * *